US011884453B2

(12) United States Patent
Jung et al.

(10) Patent No.: US 11,884,453 B2
(45) Date of Patent: Jan. 30, 2024

(54) CHILD SAFETY ZIPPER AND CHILD SAFETY ZIPPER BAG WITH THE SAME

(71) Applicant: ZIPPIAN CO., LTD., Bucheon-si (KR)

(72) Inventors: Sang Kil Jung, Bucheon-si (KR); Won Sang Cho, Bucheon-si (KR); Moon Seok Shim, Bucheon-si (KR)

(73) Assignee: ZIPPIAN CO., LTD., Bucheon-si (KR)

( * ) Notice: Subject to any disclaimer, the term of this patent is extended or adjusted under 35 U.S.C. 154(b) by 0 days.

(21) Appl. No.: 17/781,615

(22) PCT Filed: Mar. 2, 2020

(86) PCT No.: PCT/KR2020/002962
§ 371 (c)(1),
(2) Date: Jun. 1, 2022

(87) PCT Pub. No.: WO2021/153844
PCT Pub. Date: Aug. 5, 2021

(65) Prior Publication Data

US 2023/0002122 A1 Jan. 5, 2023

(30) Foreign Application Priority Data

Jan. 30, 2020 (KR) ..... 10-2020-0011262

(51) Int. Cl.
*B65D 33/25* (2006.01)

(52) U.S. Cl.
CPC ..... *B65D 33/2541* (2013.01); *B65D 2215/02* (2013.01)

(58) Field of Classification Search
CPC ..... B65D 33/2541; B65D 2215/02
USPC ..... 383/63
See application file for complete search history.

(56) References Cited

U.S. PATENT DOCUMENTS 4,863,286 A * 9/1989 Branson ..... B65D 33/2541 24/585.12
4,878,763 A * 11/1989 Ausnit ..... B65D 33/2541 24/585.12
2016/0122086 A1 5/2016 Sprehe

FOREIGN PATENT DOCUMENTS

CN 103523351 A 1/2014
CN 110641823 A * 1/2020 ..... B65D 33/2508
JP 2011-036642 A 2/2011
KR 20090012661 U * 12/2009
KR 20-0451613 Y1 12/2010
KR 10-2058080 B1 12/2019
KR 20210116063 A * 9/2021
WO 2007-050690 A1 5/2007

OTHER PUBLICATIONS

Machine translation of KR-20090012661-U (published as KR200451613Y1).*

* cited by examiner

*Primary Examiner* — Jes F Pascua
(74) *Attorney, Agent, or Firm* — NKL LAW; Jae Youn Kim

(57) ABSTRACT

A child safety zipper includes a first zipper strip that is attached to an inside wall on one side of a plastic bag and a second zipper strip that is attached to an inside wall on the other side of the plastic bag and is coupled to the first zipper strip to seal the plastic bag.

15 Claims, 7 Drawing Sheets

(a)

(b)

(a)

(b)

CHILD SAFETY ZIPPER AND CHILD SAFETY ZIPPER BAG WITH THE SAME

TECHNICAL FIELD

The present invention relates to a child safety zipper and a child safety zipper bag with the same, and more specifically, to a child safety zipper and a child safety zipper bag with the same which enable strong coupling to be fulfilled so as to tightly seal an inside of the plastic bag and can effectively prevent a child from opening the plastic bag.

BACKGROUND ART

In general, plastic bags made of vinyl are used to pack food or the like and are divided into a disposable type of plastic bag which is discarded after being used once and a reusable type of plastic bag which can be resealed. Of the plastic bags, the reusable type of plastic bag is sealed by a zipper structure including external and internal coupling units and has a zipper strip provided on inside surfaces on a mouth side of the plastic bag which is open on one side. Thus, when contents are put into the inside of the plastic bag and pressure is applied thereto, the inside of the plastic bag is sealed. Various types of zipper structures as described above are already proposed and are actively developed in various shapes to increase the sealing force.

On the other hand, the plastic bag needs to be prevented from being easily opened even when a force is applied from outside depending on contents stored in the plastic bag, and a safety problem arises particularly when the plastic bag contains contents which needs to be kept out of reach of a child or an infant. A zipper with a double- or triple-coupling structure is applied to the plastic bag with consideration for the problem in some cases; however, such zipper can also be easily opened. Consequently, a plastic bag with a separate safety lock device is developed; however, a problem arises in that the plastic bag is inconvenient to use and costs are increased due to the additional safety lock device.

In this respect, there is a demand for a zipper and a zipper bag which have a structure that enables an inside of a plastic bag to be tightly sealed and can effectively prevent a child from opening the plastic bag.

SUMMARY OF INVENTION

Technical Problem

A technical object of the present invention is to provide a child safety zipper that enables strong coupling to be fulfilled so as to tightly seal an inside of a plastic bag and can effectively prevent a child from opening the plastic bag.

Another technical object of the present invention is to provide a child safety zipper bag that enables strong coupling to be fulfilled so as to tightly seal an inside of the plastic bag and can effectively prevent a child from opening the plastic bag.

Technical objects of the present invention are not limited to the technical objects mentioned above, and the following description enables those skilled in the art to clearly understand additional unmentioned technical objects.

Solution to Problem

According to an embodiment of the present invention to achieve the technical object, there is provided a child safety zipper including: a first zipper strip having a first band unit that is attached to an inside wall on one side of a plastic bag, a first connection unit that extends from the first band unit, a first base unit that is expanded from the first connection unit and is formed to overlap the first band unit in parallel with each other, a pair of first hook units which projects in parallel with each other from the first base unit, and a first support unit that is separated from the first hook units and projects from the first base unit; and a second zipper strip that is coupled to the first zipper strip to seal the plastic bag, the second zipper strip having a second band unit that is formed in parallel with the first band unit and is attached to an inside wall on the other side of the plastic bag, a second connection unit that extends from the second band unit, a second base unit that is expanded from the second connection unit and is formed to overlap the first base unit in parallel with each other, a pair of second hook units which projects in parallel with each other from the second base unit and is hooked to the pair of first hook units, respectively, and a second support unit that is separated from the second hook units and projects from the second base unit. The first connection unit and the second connection unit are each formed on one side from each center of the first band unit and the second band unit. The first support unit and the second support unit are formed to extend in a straight line from the first connection unit and the second connection unit, respectively.

The first base unit and the second base unit may be formed to be thicker than the first band unit and the second band unit, respectively.

The first hook units and the second hook units may have respective columns which extend from the first base unit and the second base unit and respective hooks which are curved from respective edge portions of the columns toward one side. The columns may be formed to have respective central axes inclined toward the hooks, respectively.

The columns may be each formed into a taper shape which decreases in width as being away from the first base unit or the second base unit and may be formed to have respective sloping surfaces on an opposite side of the hooks.

Sides of the columns from which the respective hooks project may be formed to be perpendicular or slope toward a direction in which the hooks project.

The first hook units and the second hook units may be disposed in parallel with each other as pairs at respective parts on one side of the first support unit and the second support unit. The hooks may project toward the first support unit and the second support unit, respectively. An outer hook unit farther from the first support unit or the second support unit may have the column which is curved toward the hook.

An inner hook unit positioned between the outer hook unit and the first support unit or the second support unit may have the column, which is in contact with the first base unit or the second base unit, having a width larger than a width of the column of the outer hook unit which is in contact with the first base unit or the second base unit.

An inner hook unit positioned between the outer hook unit and the first support unit or the second support unit may have the column formed into a taper shape which decreases in width as being away from the first base unit or the second base unit and is formed to have a sloping surface on an opposite side of the hook.

Embayment portions embayed inward toward the first connection unit and the second connection unit, respectively, may be formed both between the first band unit and the first base unit and between the second band unit and the second base unit. The embayment portions may be each formed to be embayed more inward than the inner hook unit.

The columns of the first hook units may come into close contact with and be fitted between the second support unit and the second hook units. The columns of the second hook units may come into close contact with and be fitted between the first support unit and the first hook units.

The first support unit and the second support unit may gradually decrease in width as being away from the first base unit and the second base unit, respectively. Each of the first support unit and the second support unit may have a curved surface which comes into contact with the second hook units or the first hook units and comes into close contact with the columns of the second hook units or the first hook units.

The first base unit and the second base unit may be each formed to have a width larger than a width of each of the columns of the first hook units and the second hook units.

The first support unit and the second support unit may extend perpendicularly from the first connection unit and the second connection unit, respectively. The first base unit and the second base unit may be formed to extend laterally from the first support unit and the second support unit, respectively.

The first connection unit, the first base unit, the first hook units, and the first support unit may form a point symmetric figure together with the second connection unit, the second base unit, the second hook units, and the second support unit.

According to another embodiment of the present invention to achieve the other technical object, there is provided a child safety zipper bag including: a plastic bag; and a child safety zipper including a first zipper strip having a first band unit that is attached to an inside wall on one side of the plastic bag, a first connection unit that extends from the first band unit, a first base unit that is expanded from the first connection unit and is formed to overlap the first band unit in parallel with each other, a pair of first hook units which projects in parallel with each other from the first base unit, and a first support unit that is separated from the first hook units and projects from the first base unit, and a second zipper strip that is coupled to the first zipper strip to seal the plastic bag, the second zipper strip having a second band unit that is formed in parallel with the first band unit and is attached to an inside wall on the other side of the plastic bag, a second connection unit that extends from the second band unit, a second base unit that is expanded from the second connection unit and is formed to overlap the first base unit in parallel with each other, a pair of second hook units which projects in parallel with each other from the second base unit and is hooked to the pair of first hook units, respectively, and a second support unit that is separated from the second hook units and projects from the second base unit. The first connection unit and the second connection unit are each formed on one side from each center of the first band unit and the second band unit. The first support unit and the second support unit are formed to extend in a straight line from the first connection unit and the second connection unit, respectively.

The first base unit and the second base unit may be formed to be thicker than the first band unit and the second band unit, respectively.

The first hook units and the second hook units may have respective columns which extend from the first base unit and the second base unit and respective hooks which are curved from respective edge portions of the columns toward one side. The columns may be formed to have respective central axes inclined toward the hooks, respectively.

The first hook units and the second hook units may be disposed in parallel with each other as pairs at respective parts on one side of the first support unit and the second support unit. The hooks may project toward the first support unit and the second support unit, respectively. An outer hook unit farther from the first support unit or the second support unit may have the column which is curved toward the hook.

The columns of the first hook units may come into close contact with and be fitted between the second support unit and the second hook units. The columns of the second hook units may come into close contact with and be fitted between the first support unit and the first hook units.

Each of the first band unit and the second band unit may have a distance from an edge of the plastic bag and may have at least a part which is attached to an inside wall of the plastic bag.

Advantageous Effects of Invention

According to the present invention, a first zipper strip and a second zipper strip are strongly coupled to each other to tightly seal an inside of a plastic bag.

In addition, since a coupled state is maintained when opening of the plastic bag is attempted by a general method of stretching and separating the first zipper strip and the second zipper strip from each other toward both sides, and the uncoupling is performed by twisting and stretching the plastic bag in a length direction of the zipper strips, it is possible to effectively prevent a child from opening the plastic bag with a simple structure.

DESCRIPTION OF EMBODIMENTS

Advantages, features, and methods for achieving the advantages and the features are to be more clearly described with reference to embodiments which will be described below in detail together with the accompanying drawings. However, the present invention is not limited to the embodiments disclosed hereinafter but can be realized as various different embodiments; the embodiments are only provided to complete the disclosure of the present invention and completely inform those with ordinary skill in the art to which the present invention pertains of the scope of the present invention, and the present invention is only defined by the scope of the claims. Through the entire specification, the same reference signs represent the same configurational elements, respectively.

Hereinafter, a child safety zipper 1 and a child safety zipper bag 3 according to an embodiment of the present invention will be described in detail with reference to FIGS. 1 to 5.

Figure 1:
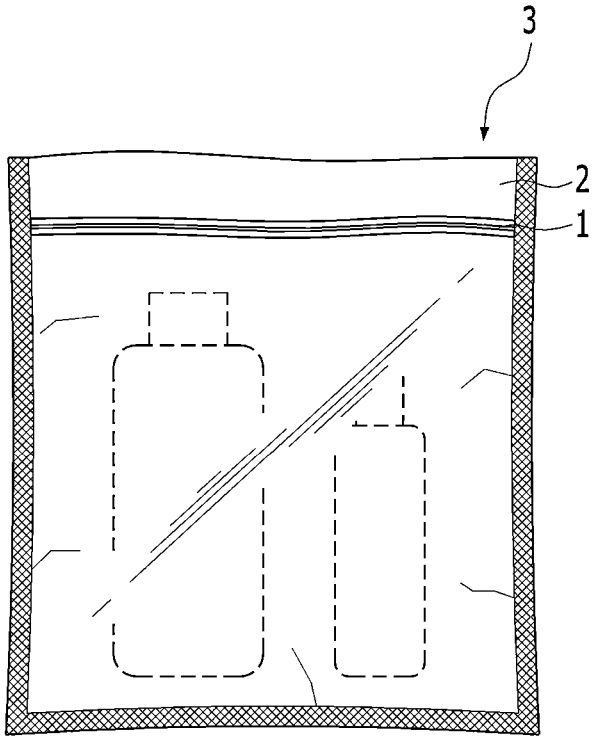
FIG. 1 is a view illustrating a child safety zipper bag to which a child safety zipper according to an embodiment of the present invention is attached.

FIG. 1 is a view illustrating a child safety zipper bag to which a child safety zipper according to an embodiment of the present invention is attached.

The child safety zipper bag 3 according to the embodiment of the present invention includes the child safety zipper 1 that is formed into a band shape extending in one direction and seals the plastic bag 2, and the child safety zipper bag is a kind of household goods which effectively protects contents contained in a plastic bag 2 from an external environment.

The child safety zipper 1 and the child safety zipper bag 3 have a first zipper strip (refer to Reference sign 10 in FIG. 2) and a second zipper strip (refer to Reference sign 20 in FIG. 2) which are strongly coupled to each other to tightly seal the inside of the plastic bag 2. In addition, since a coupled state is maintained when opening of the plastic bag is attempted by a general method of stretching and separating the first zipper strip 10 and the second zipper strip 20 from each other toward both sides, and the uncoupling is performed by twisting and stretching the plastic bag in the length direction of the zipper strips, the child safety zipper 1 and the child safety zipper bag 3 can effectively prevent a child from opening the plastic bag 2 with a simple structure.

Hereinafter, the child safety zipper 1 and the child safety zipper bag 3 will be described in detail with reference to FIGS. 2 and 3.

Figure 2:
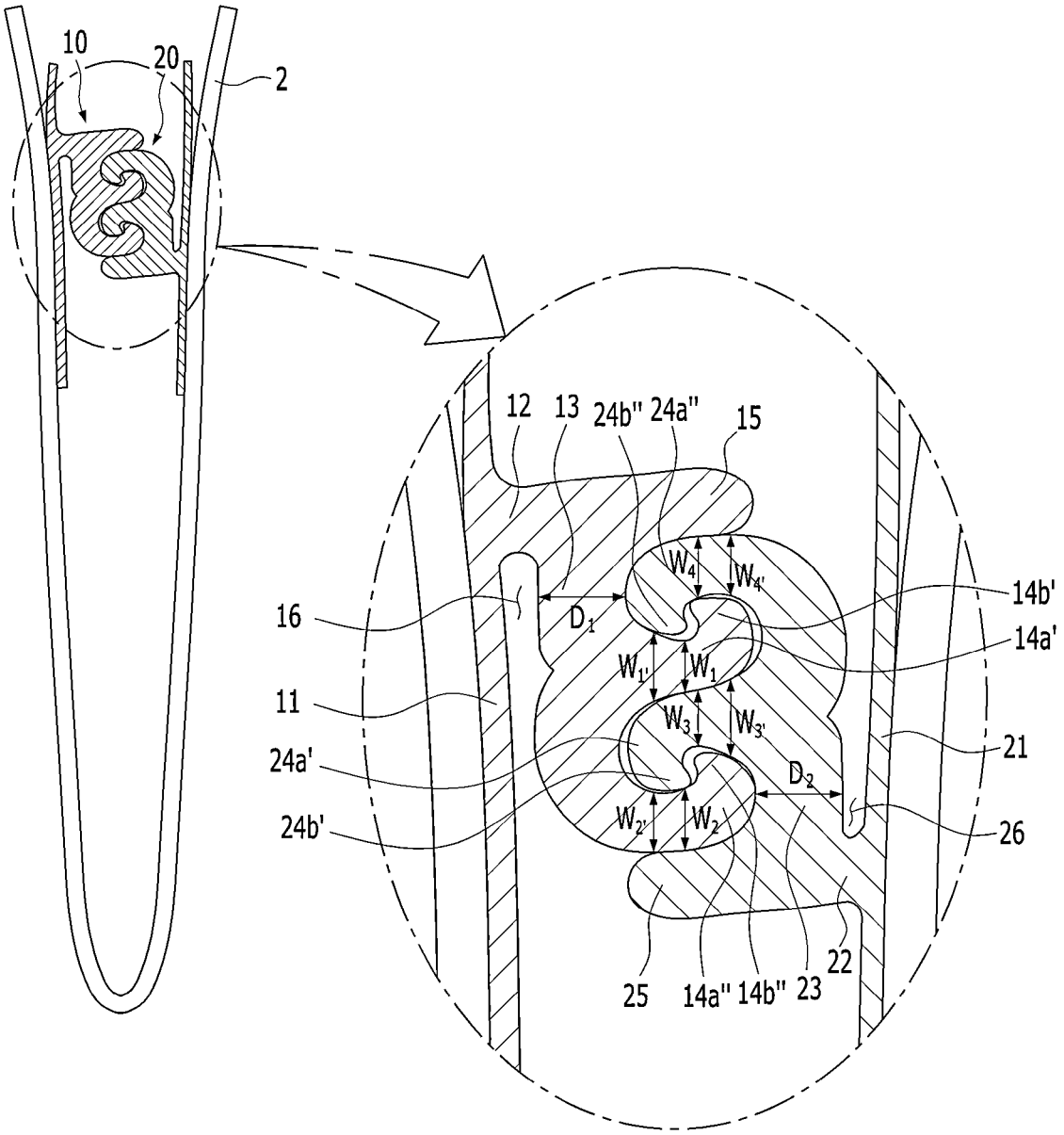
FIG. 2 is a longitudinal-sectional view of the child safety zipper bag illustrated in FIG. 1.
Figure 3:
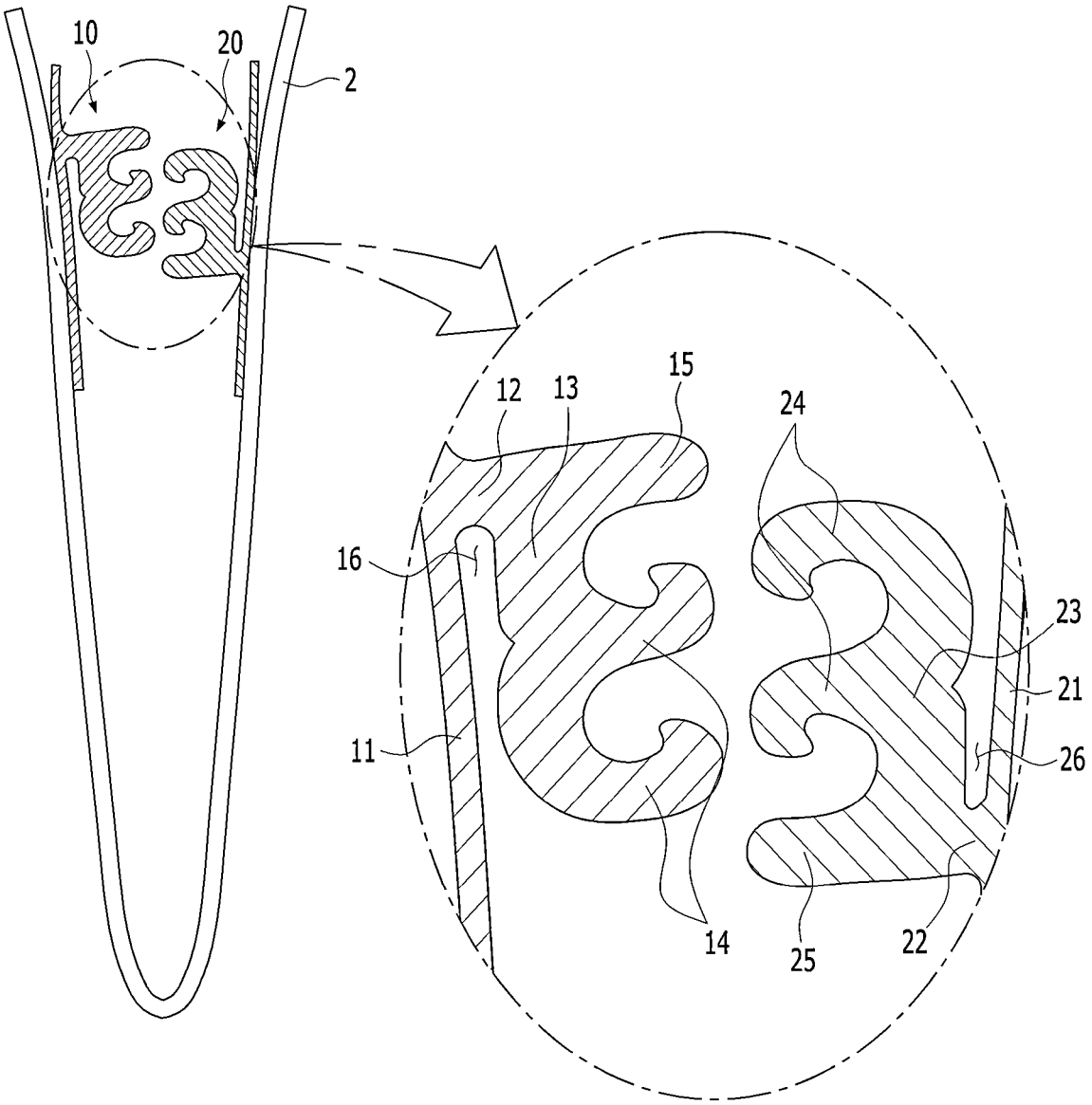
FIG. 3 is a longitudinal-sectional view illustrating a state where the child safety zipper is uncoupled.

FIG. 2 is a longitudinal-sectional view of the child safety zipper bag illustrated in FIG. 1, and FIG. 3 is a longitudinal-sectional view illustrating a state where the child safety zipper is uncoupled.

The child safety zipper 1 according to the present invention includes the first zipper strip 10 and the second zipper strip 20.

The first zipper strip 10 forms a part of the child safety zipper 1 and can be attached to an inside wall on one side of the plastic bag 2 in a width direction thereof. The first zipper strip 10 has a first band unit 11, a first connection unit 12, a first base unit 13, first hook units 14, and a first support unit 15.

The first band unit 11 is a member having a band shape extending in one direction, is attached to the inside wall on the one side of the plastic bag 2, and supports the first base unit 13, the first hook units 14, and the first support unit 15 which will be described below. The first band unit 11 is disposed in parallel with the inside wall on the one side of the plastic bag 2 and has at least a part which is attached to the inside wall of the plastic bag 2 with distance from an opened top edge of the plastic bag 2. In this case, as illustrated in the drawings, an upper end of the first band unit 11 which is close to the top edge of the plastic bag 2 can be detached from the inside wall of the plastic bag 2, and a lower end of the first band unit which is distant from the top edge of the plastic bag 2 can be attached to the inside wall of the plastic bag 2. The first connection unit 12 is formed on the other side opposite to the one side of the inside wall of the plastic bag 2 to which the first band unit 11 is attached.

The first connection unit 12 is a portion which perpendicularly extends from the first band unit 11 and can be formed on one side from the center of the first band unit 11. The first connection unit 12 is disposed to have a distance from the upper end of the first band unit 11 and connects the first band unit 11 and the first base unit 13.

The first base unit 13 can be expanded in a perpendicular direction from the first connection unit 12 and can be formed to overlap the first band unit 11 in parallel with each other. In other words, the first band unit 11 and the first base unit 13 are disposed in parallel with the inside wall of the plastic bag 2 to overlap each other and are connected to each other by the first connection unit 12. In this case, the first base unit 13 can be formed to have a thickness D1 which is thicker than that of the first band unit 11 and can be thicker than a width W1 or W2 of a column 14*a*' or 14*a*" of the first hook units 14. A pair of first hook units 14 and the first support unit 15 project from the first base unit 13.

The first hook units 14 are provided for coupling to the second zipper strip 20, and the pair of first hook units can project in parallel with each other from the first base unit 13. The pair of first hook units 14 can have respective columns 14*a*' and 14*a*", which extend from the first base unit 13, and respective hooks 14*b*' and 14*b*", which are curved from respective edge portions of the columns 14*a*' and 14*a*" toward one side, more specifically toward the upper side. In this case, the columns 14*a*' and 14*a*" can be formed to have respective central axes inclined toward the hooks 14*b*' and 14*b*", respectively. Here, inclining of the central axes of the columns 14*a*' and 14*a*" toward the hooks 14*b*' and 14*b*" means that the central axes are not perpendicular to the first base unit 13 but oblique at a certain angle. In addition, the columns 14*a*' and 14*a*" are each formed into a taper shape which decreases in width as being away from the first base unit 13 to have sloping surfaces on an opposite side of hooks 14*b*' and 14*b*". Sides of the columns from which the hooks 14*b*' and 14*b*" project may be formed to be perpendicular or slope from the first base unit 13 in a direction in which the hooks 14*b*' and 14*b*" project.

The first support unit 15 fulfils a function of maintaining the coupling of the first zipper strip 10 to the second zipper strip 20 and can be separated from the first hook units 14 and can project from the first base unit 13. In this case, the first support unit 15 can be formed to extend in a straight line from the first connection unit 12 and to gradually decrease in width as being away from the first base unit 13. In addition, the first support unit 15 can be formed to extend perpendicularly from the first connection unit 12, and the first base unit 13 can be formed to extend laterally from the first support unit 15. Since the first support unit 15 extends from the first connection unit 12, the pair of first hook units 14 described above can be disposed in parallel with each other on one side of the first support unit 15, more specifically below the first support unit 15, and the hooks 14*b*' and 14*b*" can project toward the first support unit 15. In this case, an outer hook unit farther from the first support unit 15 can have the column 14*a*" which is curved toward the hook 14*b*", and an inner hook unit positioned between the first support unit 15 and the outer hook unit can have the column 14*a*' which is in contact with the first base unit 13, the column 14*a*' having a width W1' larger than a width W2' of the column 14*a*" of the outer hook unit which is in contact with the first base unit 13. In addition, the inner hook unit positioned between the first support unit 15 and the outer hook unit can have the column 14*a*' formed into a taper shape which decreases in width as being away from the first base unit 13 and is formed to have a sloping surface on an opposite side of the hook 14*b*'.

On the other hand, an embayment portion 16 is formed between the first band unit 11 and the first base unit 13. The embayment portion 16 can be embayed inward toward the first connection unit 12 and can be formed to be embayed more inward than the inner hook unit.

The first zipper strip 10 is coupled to the second zipper strip 20.

The second zipper strip 20 forms the rest of the child safety zipper 1 and can be attached to an inside wall on the other side of the plastic bag 2 in the width direction thereof to be coupled to the first zipper strip 10 and seal the plastic bag 2. The second zipper strip 20 has a second band unit 21, a second connection unit 22, a second base unit 23, second hook units 24, and a second support unit 25.

The second band unit 21 is a member having a band shape extending in one direction, is formed in parallel with the first band unit 11, is attached to the inside wall on the other side of the plastic bag 2, and supports the second base unit 23, the second hook units 24, and the second support unit 25 which will be described below. The second band unit 21 is disposed in parallel with the inside wall on the other side of the plastic bag 2 and has at least a part which is attached to the inside wall of the plastic bag 2 with distance from an opened top edge of the plastic bag 2. In this case, as illustrated in the drawings, an upper end of the second band unit 21 which is close to the top edge of the plastic bag 2 can be detached from the inside wall of the plastic bag 2, and a lower end of the second band unit which is distant from the top edge of the plastic bag 2 can be attached to the inside wall of the plastic bag 2. The first band unit 11 and the second band unit 21 are attached with distance from the opened top edge of the plastic bag 2, and thereby a user can apply a force to the first zipper strip 10 and the second zipper strip 20 while holding and twisting the plastic bag 2 which extends more upward from the first band unit 11 and the second band unit 21 when the first zipper strip 10 and the second zipper strip 20 are uncoupled from each other. In particular, since the upper ends of the first band unit 11 and the second band unit 21 are detached from the inside walls of the plastic bag 2, a user can insert a hand between the plastic bag 2 and the first band unit 11 or the second band unit 21 to come closer to the first zipper strip 10 and the second zipper strip 20 and hold the plastic bag 2 such that the user can apply a concentrated force to the first zipper strip 10 and the second zipper strip 20. The first band unit 11 and the second band unit 21 are illustrated to have the same length in the drawings; however, the length thereof is not limited thereto, and the first band unit 11 and the second band unit 21 can have lengths different from each other. The second connection unit 22 is formed on the other side opposite to the one side of the inside wall of the plastic bag 2 to which the second band unit 21 is attached.

The second connection unit 22 is a portion which perpendicularly extends from the second band unit 21 and can be formed on one side from the center of the second band unit 21. The second connection unit 22 is disposed to have a distance from the upper end of the second band unit 21 and connects the second band unit 21 and the second base unit 23. In this case, a length of the second band unit 21 which extends more upward from the second connection unit 22 can be longer than the length of the first band unit 11 which extends more upward from the first connection unit 12. In other words, the second connection unit 22 is positioned below the first connection unit 12.

The second base unit 23 can be expanded in a perpendicular direction from the second connection unit 22 and can be formed to overlap the first base unit 13 and the second band unit 21 in parallel with each other. In other words, the second band unit 21 and the second base unit 23 are disposed in parallel with the inside wall of the plastic bag 2 to overlap each other and are connected to each other by the second connection unit 22. In this case, the second base unit 23 can be formed to have a thickness D2 which is thicker than a thickness of the second band unit 21 and can be thicker than a width W3 or W4 of a column 24*a*' or 24*a*" of the second hook units 24. The first base unit 13 and the second base unit 23 can be formed to be thicker than the first band unit 11 and the second band unit 21, respectively, and are formed to be thicker than a width W1, W2, W3, or W4 of the column 14*a*' or 14*a*" of the first hook units 14 and the column 24*a*' or 24*a*" of the second hook units 24. In this case, even when a force is applied to the first zipper strip 10 and the second zipper strip 20 while the plastic bag 2 is held and twisted, the first base unit 13 and the second base unit 23 are not deformed such that the first zipper strip 10 and the second zipper strip 20 can be uncoupled from each other and then can be recoupled to be used. When the first base unit 13 and the second base unit 23 are formed to be thinner than the first band unit 11 and the second band unit 21, respectively, or are formed to be thinner than the width W1, W2, W3, or W4 of the column 14*a*' or 14*a*" of the first hook units 14 and the column 24*a*' or 24*a*" of the second hook units 24, the first base unit 13 and the second base unit 23 are distorted and deformed when the plastic bag 2 is held and twisted in order to uncouple the first zipper strip 10 from the second zipper strip 20. In this case, it is not possible to uncouple the first zipper strip 10 from the second zipper strip 20 and to recouple and reuse the zipper strips. According to the present invention, thicknesses D1 and D2 of the first base unit 13 and the second base unit 23 are thicker than thicknesses of the first band unit 11 and the second band unit 21, respectively, and are thicker than the width W1, W2, W3, or W4 of the column 14*a*' or 14*a*" of the first hook units 14 or the column 24*a*' or 24*a*" of the second hook units 24 such that it is possible to effectively inhibit the first base unit 13 and the second base unit 23 from being deformed when the plastic bag 2 is held and twisted. A pair of second hook units 24 and the second support unit 25 project from the second base unit 23.

The second hook units 24 are provided for coupling to the first zipper strip 10, and the pair of second hook units can project in parallel with each other from the second base unit 23 and can be coupled to the first hook units 14, respectively. The pair of second hook units 24 can have respective columns 24*a*' and 24*a*" which extend from the second base unit 23 and respective hooks 24*b*' and 24*b*" which are curved from respective edge portions of the columns 24*a*' and 24*a*" toward one side, more specifically toward the lower side. In this case, the columns 24*a*' and 24*a*" can be formed to have respective central axes inclined toward the hooks 24*b*' and 24*b*", respectively. Here, inclining of the central axes of the columns 24*a*' and 24*a*" toward the hooks 24*b*' and 24*b*" means that the central axes are not perpendicular to the second base unit 23 but oblique at a certain angle. The central axes of the columns 14*a*', 14*a*", 24*a*', and 24*a*" of the first hook units 14 and the second hook units 24 are inclined toward the hooks 14*b*', 14*b*", 24*b*', and 24*b*", respectively, and thereby the columns 14*a*', 14*a*", 24*a*', and 24*a*" can be formed to have respective slope surfaces on the other side opposite to the one side on which the hooks 14*b*', 14*b*", 24*b*', and 24*b*" are formed. Consequently, when the plastic bag 2 is held and twisted, the first zipper strip 10 and the second zipper strip 20 can be uncoupled from each other as the first hook units 14, particularly the inner hook unit, and the second hook units 24, particularly the inner hook unit, slide over the slope surfaces in opposite directions from each other, respectively. In addition, the columns 24*a*' and 24*a*" are each formed into a taper shape which decreases in width as being away from the second base unit 23 to have sloping surfaces on an opposite side of hooks 24*b*' and 24*b*". Sides of the columns from which the hooks 24*b*' and 24*b*" project can be formed to be perpendicular or slope from the second base unit 23 in a direction in which the hooks 24*b*' and 24*b*" project.

The second support unit 25 fulfils a function of maintaining the coupling of the first zipper strip 10 to the second zipper strip 20 and can be separated from the second hook units 24 and can project from the second base unit 23. In this case, the second support unit 25 can be formed to extend in a straight line from the second connection unit 22 and to gradually decrease in width as being away from the second base unit 23. In addition, the second support unit 25 can be formed to extend perpendicularly from the second connection unit 22, and the second base unit 23 can be formed to extend laterally from the second support unit 25. Since the second support unit 25 extends from the second connection unit 22, the pair of second hook units 24 described above can be disposed in parallel with each other on one side of the second support unit 25, more specifically above the second support unit 25, and the hooks 24*b*' and 24*b*" can project toward the second support unit 25. In this case, an outer hook unit farther from the second support unit 25 can have the column 24*a*" which is curved toward the hook 24*b*", and an inner hook unit positioned between the second support unit 25 and the outer hook unit can have the column 24*a*' which is in contact with the second base unit 23, the column 24*a*' having a width W3' larger than a width W4' of the column 24*a*" of the outer hook unit which is in contact with the second base unit 23. The inner hook unit positioned between the outer hook unit and the first support unit 15 or the second support unit 25 has the column 14*a*' or 24*a*', which is in contact with the first base unit 13 or the second base unit 23, having a width W1' or W3' larger than a width W2' or W4' of the column 14*a*" or 24*a*" of the outer hook unit which is in contact with the first base unit 13 or the second base unit 23. In this manner, a supporting force of the inner hook unit is higher than a supporting force of the outer hook unit such that the coupling of the first zipper strip 10 to the second zipper strip 20 can be stably maintained. In addition, the inner hook unit positioned between the second support unit 25 and the outer hook unit can have the column 24*a*' formed into a taper shape which decreases in width as being away from the second base unit 23 and is formed to have a sloping surface on an opposite side of the hook 24*b*'. In other words, the columns 14*a*' and 14*a*" of the first hook units 14 come into close contact with and be fitted between the second support unit 25 and the second hook units 24, and the columns 24*a*' and 24*a*" of the second hook units 24 come into close contact with and be fitted between the first support unit 15 and the first hook units 14. In this case, the first base unit 13 can come into close contact with the outer hook unit of the second hook units 24, and the second base unit 23 can come into close contact with the outer hook unit of the first hook units 14. On the other hand, the first base unit 13 can be separated from the inner hook unit of the second hook units 24, and the second base unit 23 can be separated from the inner hook unit of the first hook units 14. In addition, the hooks 14*b*" and 24*b*" of the outer hook units can be separated from the hooks 24*b*' and 14*b*' of the inner hook units. As described above, since the columns 14*a*" and 24*a*" of the outer hook units farther from the first support unit 15 and the second support unit 25 are curved toward the hooks 14*b*" and 24*b*", the first support unit 15 and the second support unit 25 have respective curved surfaces which come into contact with the second hook unit 24 and the first hook unit 14, respectively, and the curved surfaces come into close contact with the columns 14*a*" and 24*a*" of the first hook units 14 and the second hook units 24, the outer hook units can be firmly fitted between the inner hook units and the second support unit 25 and the first support unit 15 such that a coupling force can be increased. In addition, as described above, the first base unit 13 close to the slope surface is separated from the inner hook unit of the second hook units 24, the second base unit 23 is separated from the inner hook unit of the first hook units 14, and the hooks 14*b*" and 24*b*" of the outer hook units are separated from the hooks 24*b*' and 14*b*' of the inner hook units. Hence, when the plastic bag 2 is held and twisted, the hooks 14*b*" and 24*b*" of the outer hook units can be easily uncoupled from the hooks 24*b*' and 14*b*' of the inner hook units while the inner hook unit of the first hook units 14 and the inner hook unit of the second hook units 24 slide over the slope surfaces in opposite directions.

Meanwhile, an embayment portion 26 is formed between the second band unit 21 and the second base unit 23. The embayment portion 26 can be embayed inward toward the second connection unit 22 and can be formed to be embayed more inward than the inner hook unit. The embayment portions 16 and 26 are formed both between the first band unit 11 and the first base unit 13 and between the second band unit 21 and the second base unit 23, and thereby a stretching force is not directly applied to the first hook units 14 and the second hook units 24 even when the uncoupling is attempted by a general method of holding and stretching out the plastic bag 2 out toward both sides such that the coupling can be maintained. As coupling of the first hook units 14 to the second hook units 24 is maintained when the plastic bag 2 is held and stretched out toward both sides, a child is not able to easily open the plastic bag 2, and thus the child can be prevented from being exposed to danger even when contents such as a liquid or pills are stored in the plastic bag 2.

The first connection unit 12, the first base unit 13, the first hook units 14, and the first support unit 15 can form a point symmetric figure together with the second connection unit 22, the second base unit 23, the second hook units 24, and the second support unit 25. Here, the point symmetric figure means a figure that completely overlaps an initial figure when the figure is rotated by 180° about a reference point. In other words, when the first connection unit 12, the first base unit 13, the first hook units 14, and the first support unit 15 are rotated by 180° about a reference point, the units completely overlap the second connection unit 22, the second base unit 23, the second hook units 24, and the second support unit 25. Since the first connection unit 12, the first base unit 13, the first hook units 14, and the first support unit 15 form the point symmetric figure together with the second connection unit 22, the second base unit 23, the second hook units 24, and the second support unit 25, the manufacturing thereof can be performed by using one mold. Hence, the manufacturing can be easily performed, and thereby manufacturing costs can be reduced.

The child safety zipper bag 3 according to the present invention includes the plastic bag 2 opened on one side and the child safety zipper 1 having the first zipper strip 10 and the second zipper strip 20 which are attached to the inside of the plastic bag, and contents can be contained in the child safety zipper bag.

The plastic bag 2, as a member having an envelope shape opened on one side, more specifically on the upper side, can be manufactured of vinyl. Here, the vinyl is used as a collective term for a film made of synthetic resin in a common meaning generally used in the market and can be used as the collective term not only for vinyl resin having a vinyl group but also for vinyl for a vinyl zipper bag made of a synthetic resin film such as a polyethylene film which does not have a vinyl group but is transparent and has a sunlight penetration property like vinyl used for a commercially available plastic bag, a vinyl greenhouse, or the like. The plastic bag 2 has an airtight structure excluding an opened top side, and the child safety zipper 1 is attached to the opened top side.

The child safety zipper 1 is configured of the first zipper strip 10 and the second zipper strip 20, the first zipper strip 10 has the first band unit 11, the first connection unit 12, the first base unit 13, the first hook units 14, and the first support unit 15, and the second zipper strip 20 has the second band unit 21, the second connection unit 22, the second base unit 23, the second hook units 24, and the second support unit 25. The first zipper strip 10 is attached to the inside wall on the one side of the plastic bag 2 such that the first support unit 15 is positioned toward the opened top side of the plastic bag 2 and the first hook units 14 are positioned toward the inside of the plastic bag 2, and the second zipper strip 20 is attached to the inside wall on the other side of the plastic bag 2 such that the second hook units 24 are positioned toward the opened top side of the plastic bag 2 and the second support unit 25 is positioned toward the inside of the plastic bag 2.

The child safety zipper bag 3 configured as described above can contain contents inside and can be sealed and opened repeatedly. In particular, the coupling of the first hook units 14 to the second hook units 24 is maintained so as not to allow opening when the plastic bag 2 extending more upward from the first band unit 11 and the second band unit 21 is held and stretched out toward both sides in a state where the first hook units 14 are coupled to the second hook units 24, and the first hook units 14 and the second hook units 24 are uncoupled from each other so as to allow the opening only when the plastic bag 2 is held and then twisted and stretched in the length direction of the zipper strips. Hence, an accident due to opening of the plastic bag 2 by a child can be prevented in advance.

Hereinafter, the child safety zipper 1 and working of the child safety zipper 1 will be described in detail with reference to FIGS. 4 and 5.

Figure 4:
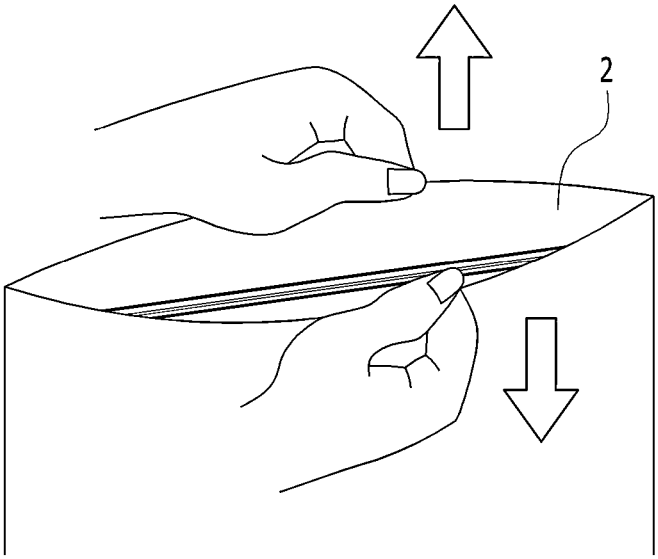
FIGS. 4A-4B and 5A-5B are operation views for illustrating working of the child safety zipper and the child safety zipper bag.
Figure 4:
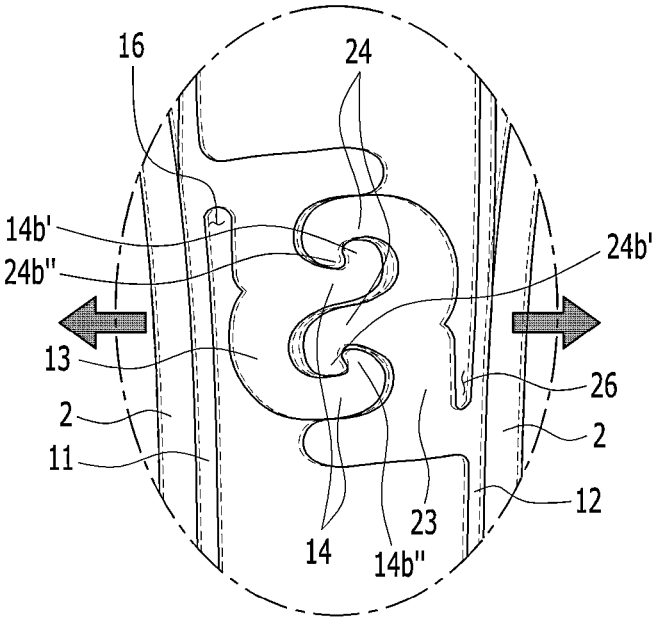
Figure 5:
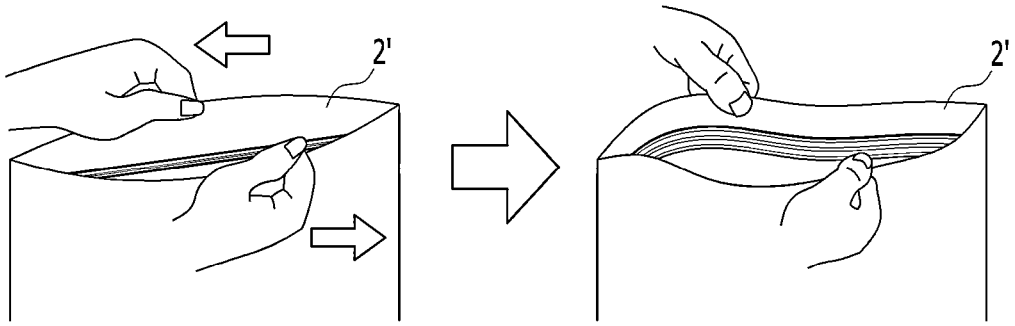
Figure 5:
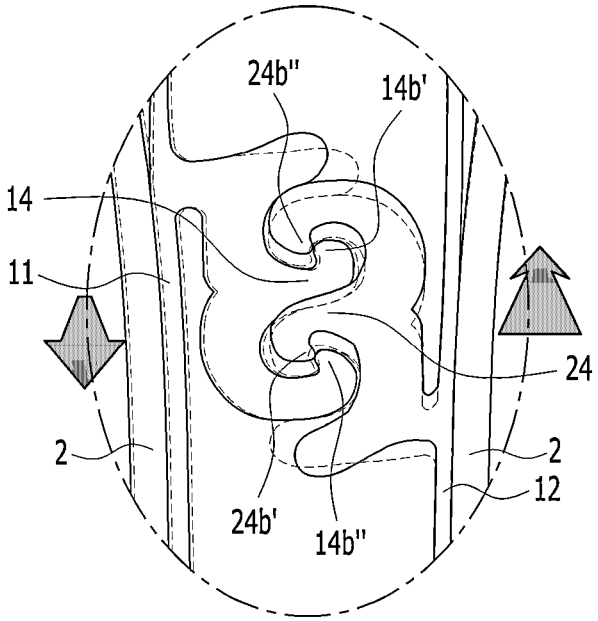

FIGS. 4 and 5 are operation views for illustrating the working of the child safety zipper and the child safety zipper bag.

The child safety zipper 1 and the child safety zipper bag 3 according to the present invention have the first zipper strip 10 and the second zipper strip 20 which are strongly coupled to each other to tightly seal the inside of the plastic bag 2. In addition, since a coupled state is maintained when opening of the plastic bag is attempted by the general method of stretching out and separating the first zipper strip 10 and the second zipper strip 20 from each other toward both sides, and the uncoupling is performed by twisting and stretching the plastic bag in the length direction of the zipper strips, it is possible to effectively prevent a child from opening the plastic bag with a simple structure.

FIGS. 4A-4B are views illustrating a state where the plastic bag is held and stretched out toward both sides, and FIGS. 5A-5B are views illustrating a state where the plastic bag is held and then twisted and stretched in the length direction of the zipper strips.

First, with reference to FIGS. 4A-4B, when the plastic bag 2 is held and stretched out toward both side, the coupling of the first hook units 14 to the second hook units 24 is maintained.

The first band unit 11 and the second band unit 21 are attached to the plastic bag 2 with distance from the opened top edge of the plastic bag. Consequently, as illustrated in FIG. 4A, a user can hold the plastic bag 2 extending more upward from both the first band unit 11 and the second band unit 21 and can stretch out the plastic bag toward both sides.

When the plastic bag 2 is held and stretched out toward both sides, as illustrated FIG. 4B, the first base unit 13 and the outer hook unit of the second hook units 24 which are in close contact with each other and the second base unit 23 and the outer hook unit of the first hook units 14 which are in close contact with each other are both separated from each other, and the hooks 14*b*" and 24*b*" of the outer hook units and the hooks 24*b*' and 14*b*' of the inner hook units which are separated from each other can come into close contact with each other. In particular, the stretching force is not directly applied to the first hook units 14 and the second hook units 24 due to the embayment portions 16 and 26 embayed more inward than the inner hook units, and thus the coupling of the first hook units 14 to the second hook units 24 can be maintained. In other words, according to the child safety zipper bag 3 of the present invention, even when a child tries to open the plastic bag 2 by the usual method of holding and stretching out the plastic bag toward both sides, the coupling of the first hook units 14 to the second hook units 24 is maintained such that a safety-related accident due to the opening of the plastic bag 2 can be prevented.

Subsequently, with reference to FIGS. 5A-5B, when the plastic bag 2 is held and then twisted and stretched in the length direction of the zipper strips, the first hook units 14 and the second hook units 24 are uncoupled from each other.

As illustrated in FIG. 5A, a user can hold the plastic bag 2 extending more upward from both the first band unit 11 and the second band unit 21 so as to twist and stretch the plastic bag in the length direction of the zipper strips. Since the upper ends of the first band unit 11 and the second band unit 21 are detached from the inside walls of the plastic bag 2, a user can insert a hand both between the first band unit 11 and the plastic bag 2 and between the second band unit 21 and the plastic bag 2 to come closer to the first zipper strip 10 and the second zipper strip 20 and can apply a force to the first hook units 14 and the second hook units 24 while holding and twisting the plastic bag 2.

When the plastic bag 2 is held and then twisted and stretched in the length direction of the zipper strips, the inner hook unit of the first hook units 14 and the inner hook unit of the second hook units 24 can slide over the slope surfaces abutting on each other in opposite directions from each other, respectively, as illustrated in FIG. 5B. The hooks 14*b*" and 24*b*" of the outer hook units and the hooks 24*b*' and 14*b*' of the inner hook units are separated from each other, and thus the inner hook unit of the first hook units 14 and the inner hook unit of the second hook units 24 can easily slide in opposite directions from each other. The inner hook unit of the first hook units 14 and the inner hook unit of the second hook units 24 can slide over the slope surfaces in the opposite directions from each other, and thereby the hooks 14*b*" and 24*b*" of the outer hook units and the hooks 24*b*' and 14*b*' of the inner hook units can be easily uncoupled from each other while the first support unit 15 and the second support unit 25 are separated from the first hook units 14 and the second hook units 24, respectively. When the hooks 14*b*" and 24*b*" of the outer hook units and the hooks 24*b*' and 14*b*' of the inner hook units are uncoupled from each other, the first support unit 15 and the second support unit 25 can return to initial locations thereof, respectively. In other words, according to the child safety zipper bag 3 of the present invention, only when an adult holds and then twists and stretches the plastic bag 2 in the length direction of the zipper strips, the first hook units 14 and the second hook units 24 are uncoupled from each other, and the plastic bag 2 can be opened.

Hereinafter, a child safety zipper 1 according to another embodiment of the present invention will be described in detail with reference to FIGS. 6A-6B and 7.

Figure 6:
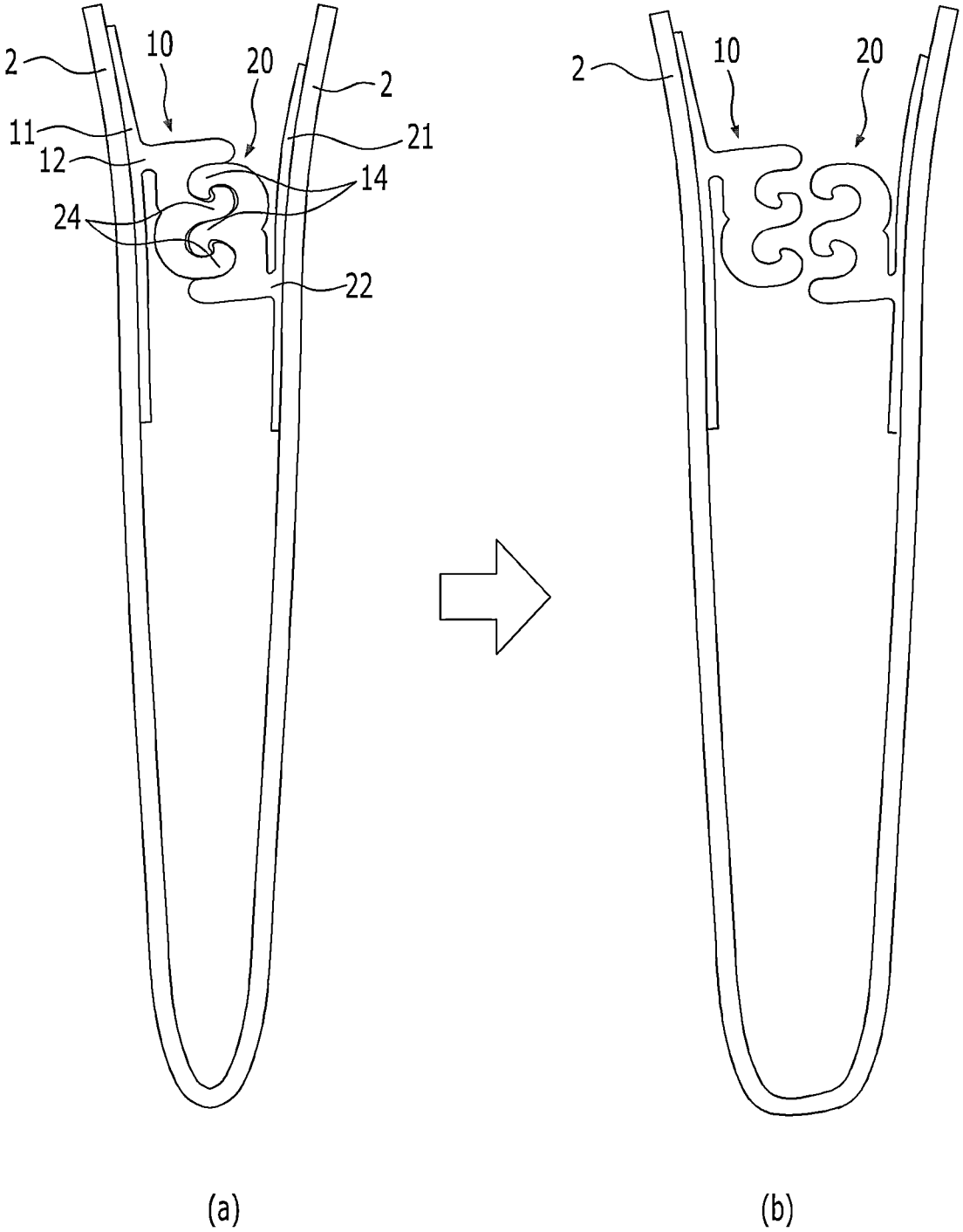
FIGS. 6A-6B are views illustrating a child safety zipper bag to which a child safety zipper according to another embodiment of the present invention is attached.
Figure 7:
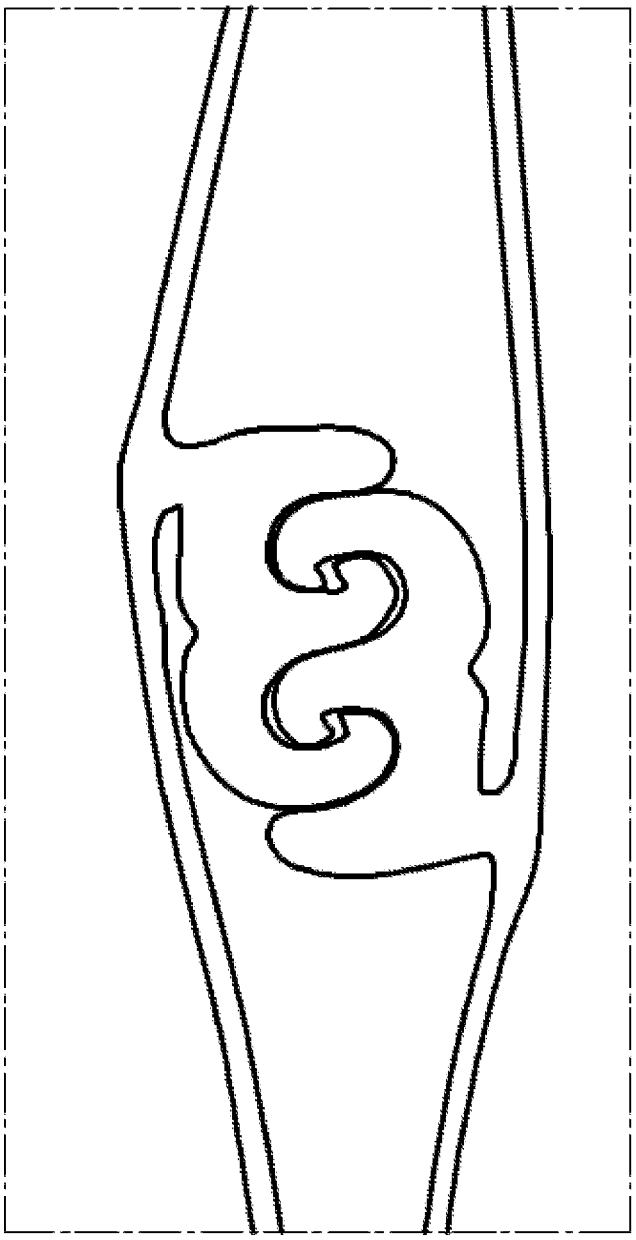
FIG. 7 is an actual longitudinal-sectional view of the child safety zipper illustrated in FIG. 6.

FIGS. 6A-6B are views illustrating a child safety zipper bag to which a child safety zipper according to the other embodiment of the present invention is attached, and FIG. 7 is an actual longitudinal-sectional view of the child safety zipper illustrated in FIGS. 6A-6B.

The child safety zipper 1 according to the other embodiment of the present invention has the first band unit 11 and the second band unit 21 which are entirely attached to the inside walls of the plastic bag 2 with distance from respective edges of the plastic bag 2, respectively. The child safety zipper 1 according to the other embodiment of the present invention is virtually the same as the above-described embodiment except that the first band unit 11 and the second band unit 21 are entirely attached to the inside walls of the plastic bag 2 with distance from the respective edges of the plastic bag 2, respectively. Consequently, the following description focuses thereon, and the descriptions of the rest of configurational units is substituted by the description provided above unless otherwise mentioned.

The first band unit 11 and the second band unit 21 are entirely attached to the inside walls of the plastic bag 2 with distance from respective edges of the plastic bag 2, respectively. More specifically, the first band unit 11 is disposed parallel to the inside wall of the plastic bag 2 on one side, and an upper end of the first band unit which is close to the top edge of the plastic bag 2 and a lower end thereof which is distant from the top edge of the plastic bag 2 are both attached to the inside wall of the plastic bag 2. In this case, a length of the first band unit 11 which extends more upward from the first connection unit 12 can be longer than the length of the first band unit which extends more upward from the first connection unit according to the embodiment of the present invention described above. The second band unit 21 is disposed parallel to the inside wall of the plastic bag 2 on the other side to be formed parallel to the first band unit 11, and an upper end of the second band unit which is close to the top edge of the plastic bag 2 and a lower end thereof which is distant from the top edge of the plastic bag 2 are both attached to the inside wall of the plastic bag 2. In this case, a length of the second band unit 21 which extends more upward from the second connection unit 22 can be longer than the length of the second band unit which extends more upward from the second connection unit according to the embodiment of the present invention described above. In other words, in the child safety zipper 1 according to the other embodiment of the present invention, the lengths of the first band unit 11 and the second band unit 21 which extend more upward from the first connection unit 12 and the second connection unit 22, respectively, can be longer such that a user can hold the first band unit 11 and the second band unit 21 together with the plastic bag 2. This can be verified by FIG. 7 illustrating a photograph of an actual longitudinal section of the child safety zipper 1. Since the upper ends of the first band unit 11 and the second band unit 21 are attached to the inside walls of the plastic bag 2, the user can hold the first band unit 11 or the second band unit 21 and the plastic bag 2 together to apply a force to the first zipper strip 10 and the second zipper strip 20 while supporting the first band unit 11 and the second band unit 21. Consequently, the first hook units 14 and the second hook units 24 can be uncoupled from each other by a weaker force. The first band unit 11 and the second band unit 21 are illustrated to have different lengths from each other in the drawings; however, the lengths thereof are not limited thereto, and the first band unit 11 and the second band unit 21 can be formed to have the same length.

As described above, the embodiments of the present invention are described with reference to the accompanying drawings; however, a person of ordinary skill in the art to which the present invention pertains can understand that the present invention can be realized as another embodiment without changing the technical idea or an essential feature of the present invention. Therefore, the embodiments described above need to be understood, in every aspect, as exemplified embodiments and not as embodiments to which the present invention is limited.

REFERENCE SIGNS LIST

| | |
|---|---|
| 1: Child Safety Zipper | 2: Plastic Bag |
| 3: Child Safety Zipper Bag | |
| 10: First Zipper Strip | 11: First Band Unit |
| 12: First Connection Unit | 13: First Base Unit |
| 14: First Hook Unit | 14a', 14a": Column |
| 14b', 14b": Hook | 15: First Support Unit |
| 16: Embayment Portion | |
| 20: Second Zipper Strip | 21: Second Band Unit |
| 22: Second Connection Unit | 23: Second Base Unit |
| 24: Second Hook Unit | 24a', 24a": Column |
| 24b', 24b": Hook | 25: Second Support Unit |
| 26: Embayment Portion | |

INDUSTRIAL APPLICABILITY

The present invention is highly applicable in industries in that strong coupling enables an inside of a plastic bag to be tightly sealed and effectively prevents a child from opening the plastic bag.

The invention claimed is:

1. A child safety zipper comprising:

a first zipper strip having a first band unit, wherein at least a part of the first band unit is attached to an inside wall on one side of a plastic bag, a first connection unit that extends from the first band unit, a first base unit that is expanded from the first connection unit and is formed to overlap the first band unit in parallel with each other, a pair of first hook units which projects in parallel with each other from the first base unit, and a first support unit that is separated from the first hook units and projects from the first base unit; and a second zipper strip that is coupled to the first zipper strip to seal the plastic bag, the second zipper strip having a second band unit that is formed in parallel with the first band unit, wherein at least a part of the second band unit is attached to an inside wall on the other side of the plastic bag, a second connection unit that extends from the second band unit, a second base unit that is expanded from the second connection unit and is formed to overlap the first base unit in parallel with each other, a pair of second hook units which projects in parallel with each other from the second base unit and is hooked to the pair of first hook units, respectively, and a second support unit that is separated from the second hook units and projects from the second base unit, wherein the first connection unit and the second connection unit are each formed on one side from each center of the first band unit and the second band unit, wherein the first support unit and the second support unit are formed to extend in a straight line from the first connection unit and the second connection unit, respectively, wherein an upper end of the first band unit is close to a top edge of the plastic bag and detached from the inside wall on the one side of the plastic bag, wherein an upper end of the second band unit is close to the top edge of the plastic bag and detached from the inside wall on the other side of the plastic bag, wherein the first base unit and the second base unit are formed to be thicker than the first band unit and the second band unit, respectively, wherein the first hook units and the second hook units are continuously curved, wherein the first hook units and the second hook units have respective columns which extend from the first base unit and the second base unit and respective hooks which are curved from respective edge portions of the columns toward one side, wherein the columns are formed to have respective central axes inclined toward the hooks, respectively, wherein the columns are each formed into a taper shape which decreases in width as being away from the first base unit or the second base unit and are each formed to have respective sloping surfaces on an opposite side of the hooks, so as to allow the opening only when the plastic bag is held and then twisted and stretched in the length direction of the first and second zipper strips, and wherein when the plastic bag is held and twisted, the first zipper strip and the second zipper strip can be uncoupled from each other as the first hook units and the second hook units slide over the sloping surfaces in opposite directions from each other, respectively.

2. The child safety zipper according to claim 1, wherein sides of the columns from which the respective hooks project are formed to be perpendicular or slope toward a direction in which the hooks project.

3. The child safety zipper according to claim 1, wherein the first hook units and the second hook units are disposed in parallel with each other as pairs at respective parts on one side of the first support unit and the second support unit, wherein the hooks project toward the first support unit and the second support unit, respectively, and wherein an outer hook unit farther from the first support unit or the second support unit has the column which is curved toward the hook.

4. The child safety zipper according to claim 3, wherein an inner hook unit positioned between the outer hook unit and the first support unit or the second support unit has the column which is in contact with the first base unit or the second base unit, the column having a width larger than a width of the column of the outer hook unit which is in contact with the first base unit or the second base unit.

5. The child safety zipper according to claim 3, wherein an inner hook unit positioned between the outer hook unit and the first support unit or the second support unit has the column formed into a taper shape which decreases in width as being away from the first base unit or the second base unit and is formed to have a sloping surface on an opposite side of the hook.

6. The child safety zipper according to claim 5, wherein embayment portions embayed inward toward the first connection unit and the second connection unit are formed both between the first band unit and the first base unit and between the second band unit and the second base unit, respectively, and wherein the embayment portions are each formed to be embayed more inward than the inner hook unit.

7. The child safety zipper according to claim 3, wherein the columns of the first hook units come into close contact with and are fitted between the second support unit and the second hook units, and wherein the columns of the second hook units come into close contact with and are fitted between the first support unit and the first hook units.

8. The child safety zipper according to claim 3, wherein the first support unit and the second support unit gradually decrease in width as being away from the first base unit and the second base unit, respectively, and wherein each of the first support unit and the second support unit has a continuously curved surface which comes into contact with the second hook units or the first hook units and comes into close contact with the columns of the second hook units or the first hook units.

9. The child safety zipper according to claim 1, wherein the first base unit and the second base unit are each formed to have a width larger than a width of each of the columns of the first hook units and the second hook units.

10. The child safety zipper according to claim 1, wherein the first support unit and the second support unit extend perpendicularly from the first connection unit and the second connection unit, respectively, and wherein the first base unit and the second base unit are formed to extend laterally from the first support unit and the second support unit, respectively.

11. The child safety zipper according to claim 1, wherein the first connection unit, the first base unit, the first hook units, and the first support unit form a point symmetric figure together with the second connection unit, the second base unit, the second hook units, and the second support unit.

12. A child safety zipper bag comprising:

a plastic bag; and a child safety zipper including a first zipper strip having a first band unit, wherein at least a part of the first band unit is attached to an inside wall on one side of the plastic bag, a first connection unit that extends from the first band unit, a first base unit that is expanded from the first connection unit and is formed to overlap the first band unit in parallel with each other, a pair of first hook units which projects in parallel with each other from the first base unit, and a first support unit that is separated from the first hook units and projects from the first base unit, and a second zipper strip that is coupled to the first zipper strip to seal the plastic bag, the second zipper strip having a second band unit that is formed in parallel with the first band unit, wherein at least a part of the second band unit is attached to an inside wall on the other side of the plastic bag, a second connection unit that extends from the second band unit, a second base unit that is expanded from the second connection unit and is formed to overlap the first base unit in parallel with each other, a pair of second hook units which projects in parallel with each other from the second base unit and is hooked to the pair of first hook units, respectively, and a second support unit that is separated from the second hook units and projects from the second base unit, wherein the first connection unit and the second connection unit are each formed on one side from each center of the first band unit and the second band unit, wherein the first support unit and the second support unit are formed to extend in a straight line from the first connection unit and the second connection unit, respectively, wherein an upper end of the first band unit is close to a top edge of the plastic bag and detached from the inside wall on the one side of the plastic bag, wherein an upper end of the second band unit is close to the top edge of the plastic bag and detached from the inside wall on the other side of the plastic bag, wherein the first base unit and the second base unit are formed to be thicker than the first band unit and the second band unit, respectively, wherein the first hook units and the second hook units are continuously curved, wherein the first hook units and the second hook units have respective columns which extend from the first base unit and the second base unit and respective hooks which are curved from respective edge portions of the columns toward one side, and wherein the columns are formed to have respective central axes inclined toward the hooks, respectively, wherein the columns are each formed into a taper shape which decreases in width as being away from the first base unit or the second base unit and are each formed to have respective sloping surfaces on an opposite side of the hooks, so as to allow the opening only when the plastic bag is held and then twisted and stretched in the length direction of the first and second zipper strips, and wherein when the plastic bag is held and twisted, the first zipper strip and the second zipper strip can be uncoupled from each other as the first hook units and the second hook units slide over the sloping surfaces in opposite directions from each other, respectively.

13. The child safety zipper bag according to claim 12, wherein the first hook units and the second hook units are disposed in parallel with each other as pairs at respective parts on one side of the first support unit and the second support unit, wherein the hooks project toward the first support unit and the second support unit, respectively, and wherein an outer hook unit farther from the first support unit or the second support unit has the column which is curved toward the hook.

14. The child safety zipper bag according to claim 13, wherein the columns of the first hook units come into close contact with and are fitted between the second support unit and the second hook units, and wherein the columns of the second hook units come into close contact with and are fitted between the first support unit and the first hook units.

15. The child safety zipper bag according to claim 14, wherein each of the first band unit and the second band unit has at least a part which is attached to an inside wall of the plastic bag with distance from an edge of the plastic bag.

* * * * *